US006585570B2

(12) United States Patent
Kim et al.

(10) Patent No.: US 6,585,570 B2
(45) Date of Patent: Jul. 1, 2003

(54) METHOD AND APPARATUS FOR SUPPLYING CHEMICAL-MECHANICAL POLISHING SLURRIES

(75) Inventors: Jung-yup Kim, Seoul (KR); Young-rae Park, Suwon (KR); Sang-rok Hah, Seoul (KR)

(73) Assignee: Samsung Electronics Co., Ltd. (KR)

( * ) Notice: Subject to any disclaimer, the term of this patent is extended or adjusted under 35 U.S.C. 154(b) by 79 days.

(21) Appl. No.: 09/848,371

(22) Filed: May 3, 2001

(65) Prior Publication Data

US 2001/0044265 A1 Nov. 22, 2001

(30) Foreign Application Priority Data

May 16, 2000 (KR) ..... 2000-26182

(51) Int. Cl.[7] ..... B24B 19/00

(52) U.S. Cl. ..... 451/60; 451/36; 451/53; 451/446; 451/41; 451/285

(58) Field of Search ..... 451/41, 36, 60, 451/285, 287, 288, 53, 446

(56) References Cited

U.S. PATENT DOCUMENTS

| | | | | |
|---|---|---|---|---|
| 5,778,911 A | | 7/1998 | Yoshio | 134/104.2 |
| 5,895,550 A | | 4/1999 | Andreas | 156/345 |
| 6,024,829 A | * | 2/2000 | Easter et al. | 156/345 |
| 6,126,531 A | * | 10/2000 | Iida et al. | 451/447 |
| 6,287,192 B1 | * | 9/2001 | Kim et al. | 457/60 |
| 6,291,350 B1 | * | 9/2001 | Hashimoto et al. | 438/692 |
| 6,352,469 B1 | * | 3/2002 | Miyazaki et al. | 451/67 |
| 6,355,184 B1 | * | 3/2002 | Crevasse | 216/93 |
| 6,423,638 B1 | * | 7/2002 | Vanell | 438/690 |

FOREIGN PATENT DOCUMENTS

| | | | |
|---|---|---|---|
| KR | 10-1999-0008228 | 3/1999 | H01L/21/304 |
| KR | 10-1999-0017990 | 12/1999 | H01L/21/304 |
| KR | 2000-0002835 | 1/2000 | H01L/21/00 |

* cited by examiner

*Primary Examiner*—Eileen P. Morgan
(74) *Attorney, Agent, or Firm*—Mills & Onello, LLP

(57) ABSTRACT

In method and apparatus for supplying a slurry for a chemical mechanical polishing (CMP) process, a slurry pretreatment is provided for minimizing the size of abrasive particles in the slurry. In the slurry supplying method, after applying acoustic energy to the slurry to de-agglomerate agglomerated abrasive particles within the slurry, any remaining oversized abrasive particles having a diameter greater than a reference size are filtered out from the slurry. The acoustic energy application step and the filtering step are repeatedly performed for a predetermined time period while circulating the slurry. The slurry supplying apparatus includes a tank for holding a slurry, acoustic energy sources for applying acoustic energy to the slurry held within the tank, a slurry circulating line for circulating the slurry drawn out of the tank, which is connected to the tank, a filter for filtering out abrasive particle clumps having a diameter greater than a reference size from the slurry, which is disposed in the slurry circulating line, and a slurry supplying line for supplying the slurry from the slurry circulating line to a CMP equipment.

13 Claims, 5 Drawing Sheets

METHOD AND APPARATUS FOR SUPPLYING CHEMICAL-MECHANICAL POLISHING SLURRIES

BACKGROUND OF THE INVENTION

1. Field of the Invention

The present invention relates to a method and apparatus for supplying slurries used in a chemical mechanical polishing (CMP) process for semiconductor device manufacture, and more particularly, to a slurry supplying method and apparatus which can perform a pre-treatment for de-agglomerating agglomerated abrasive particles within the slurry into particles of a sufficiently small size, so as not to damage the polished surface of a wafer during the CMP process.

2. Description of the Related Art

As miniaturization, high integration, and multi-layer metallization of semiconductor devices proceed, fine-pattern formation techniques are required. This results in more complicated surface configuration of semiconductor devices, and, in addition, the step difference on interlayer films becomes increasingly larger. Thus, a CMP process is used as a planarization technique for removing the step difference of a specific film formed on a substrate. In a CMP process, a slurry is provided on the surface of a thin film pattern on a wafer, and the surface of the thin film is in contact with a polishing pad. Then, the surface of the thin film chemically reacts with the slurry and the polishing pad is rotated, thereby physically polishing irregularities on the surface of the thin film to planarize the thin film.

In general, a CMP process is a technique of global planarization that cannot be achieved by the existing spin-on-glass (SOG) technique, or by etchback, thereby obtaining the polished surface having a good planarity. However, if a CMP process is carried out using slurries provided by a conventional method, a large amount of micro-scratch defects occur on the polished wafer surface. The micro scratch defects, which have been demonstrated to be created by abrasive particle clumps having a relatively large particle diameter among abrasive particles contained within a slurry, may result in electrical shorts, or bridge effects, in a wiring substrate for semiconductor integrated circuits.

Usually, abrasive particles contained in a slurry are comprised of primary particles having a diameter of about 130–170 nm. However, since abrasive particles tend to be agglomerated among unit particles that are suspended within the slurry, secondary particles having a relatively large diameter are thereby formed in clumps. The tendency of agglomeration of abrasive particles within the slurry is especially prominent when the slurry does not flow, but is instead stagnant. The range of sizes of the clumps formed by agglomeration of abrasive particles tends to lie from about 0.1 to about 30 $\mu$m, depending on the size of the primary particles within the abrasive particles. In particular, when a ceria-based slurry using cerium oxide particles (hereinafter referred to as "ceria slurry") is used, exceeding merely 1 $\mu$m in the average size of the particles within the slurry has been known to produce a large quantity of micro-scratch defects on the polished surfaces of weak films such as chemical vapor deposition (CVD) films formed by low temperature chemical reaction, or organic or inorganic deposition films.

For addressing this issue, U.S. Pat. No. 5,895,550 discloses a method in which ultrasonic transducers are connected in-line with a slurry dispense line. This method employs a single-pass system in which the slurry flows through the ultrasonic transducer connected to the slurry dispense line just prior to dispensing on the polishing pad. In a configuration that uses the ultrasonic transducers by a single-pass system, it is difficult to uniformly and effectively transmit acoustic energy of sufficient strength to de-agglomerate agglomerated abrasive particles within the slurry into primary particles.

Furthermore, since the ceria slurry is typically extracted from a highly impure mineral and obtained through processes such as high purification and granulation unlike a colloidal silica-based slurry, it inevitably contains a small amount of impurities. For this reason, the ceria slurry can contain relatively large, abrasive, particle clumps that cannot be reduced by application of acoustic energy. Clumps formed by simple agglomeration of primary particles can readily be broken apart by supplying acoustic energy; however large-sized abrasive particle clumps produced by other causes are not reducible through the application of acoustic energy.

SUMMARY OF THE INVENTION

To address the aforementioned limitations, it is a first objective of the present invention to provide a slurry supplying method which is capable of minimizing the abrasive particle size of a slurry used in a chemical mechanical polishing (CMP) process so as to avoid the generation of micro-scratch defects on the polished surface of a wafer.

It is a second objective of the present invention to provide a slurry supplying apparatus for pre-processing of a slurry for preparing the slurry to have a minimized abrasive particle size for application in a CMP process.

Accordingly, to achieve the first objective, in a slurry supplying method according to the invention, acoustic energy is applied to a slurry for a chemical mechanical polishing (CMP) process to de-agglomerate agglomerated abrasive particles within the slurry. Then, oversized abrasive particles having a diameter greater than a reference size are filtered out from the slurry to which the acoustic energy is applied. Next, the slurry is circulated while continuing to apply acoustic energy continuing to filter for a predetermined time. The slurry subjected to the circulating step is supplied onto a polishing pad of a CMP equipment.

The acoustic energy source applies acoustic energy to the slurry held within a tank. Preferably, the acoustic energy source at least a portion of which is immersed in the slurry applies acoustic energy to the slurry. The acoustic energy source may apply acoustic energy to the slurry from the bottom or the sidewalls of the tank. In this case, an ultrasonic transducer may be used as the acoustic energy source.

The slurry may comprise ceria slurry, silica slurry, or alumina slurry.

To achieve the second objective, the present invention provides a slurry supplying apparatus including a tank for holding a slurry to be used in a chemical mechanical polishing (CMP) process, acoustic energy sources for applying acoustic energy to the slurry held within the tank, a slurry circulating line for circulating the slurry drawn out of the tank, which is connected to the tank, a filter for filtering out abrasive particle clumps having a diameter greater than a reference size from the slurry, which is disposed in the slurry circulating line, and a slurry supplying line for supplying the slurry from the slurry circulating line to a CMP equipment.

The acoustic energy sources may selectively include a first acoustic energy source at least a portion of which is immersed in the slurry held within the tank, a second acoustic energy source for applying acoustic energy to the slurry from the bottom of the tank, and a third acoustic energy source for applying acoustic energy to the slurry from the sidewalls of the tank.

The slurry circulating line includes a slurry discharge line connected to an outlet of the tank and a slurry collecting line connected to an inlet of the tank. The filter may be disposed in the slurry discharge line or the slurry collecting line. The slurry circulating line may further include a bypass line for detouring the filter so that the slurry can be circulated without passing through the filter.

The method of supplying a slurry according to the present invention not only applies acoustic energy to a slurry through all regions within a slurry source sink, but also suppresses re-agglomeration of abrasive particles caused by slurry stagnation since the slurry is continuously maintained not in a stagnant state, but rather in a fluid state.

Furthermore, since there is no danger that agglomerated abrasive particles or oversize abrasive particles will exist within a slurry provided through the slurry supplying apparatus according to the present invention, the apparatus can suppress production of micro-scratches which may cause defects in a semiconductor device on the polished surface of a wafer during a CMP process.

BRIEF DESCRIPTION OF THE DRAWINGS

The above objectives and advantages of the present invention will become more apparent by describing in detail preferred embodiments thereof with reference to the attached drawings in which.

DETAILED DESCRIPTION OF PREFERRED EMBODIMENTS

Figure 1:
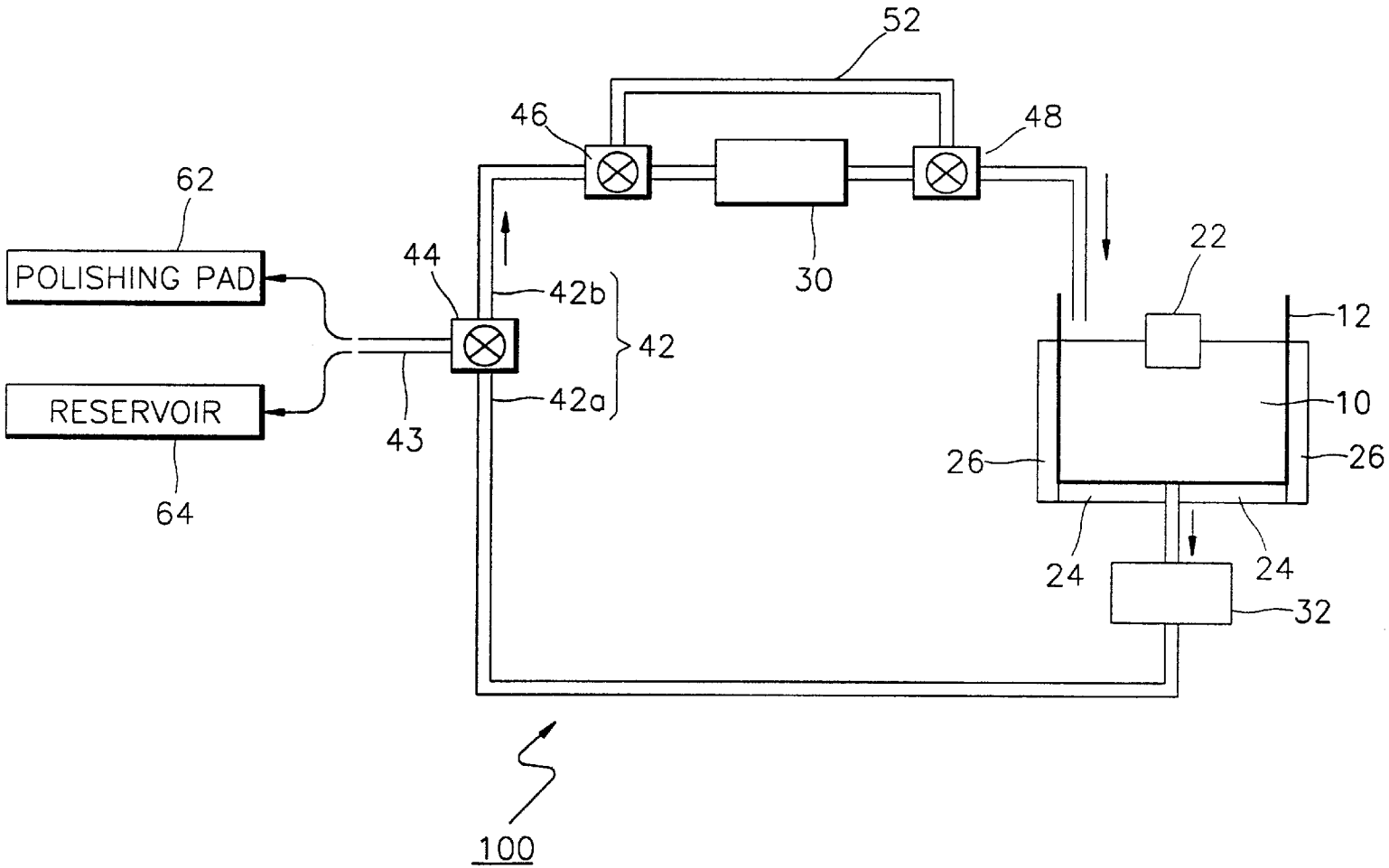
FIG. 1 schematically illustrates the configuration of a primary portion of a slurry supplying apparatus according to a first preferred embodiment of the present invention.

Referring to FIG. 1, a slurry supplying apparatus 100 according to the present invention includes a slurry source tank 12 for holding a slurry 10 to be used in a chemical mechanical polishing (CMP) process, and acoustic energy sources 22, 24, and 26 for applying acoustic energy to the slurry 10 held within the slurry tank source 12. The acoustic energy sources 22, 24, and 26 may comprise, for example, ultrasonic transducers. In order to uniformly transfer acoustic energy generated by the acoustic energy sources 22, 24, and 26 to the slurry 10, the acoustic energy sources 22, 24, and 26 include a first acoustic energy source 22 at least a portion of which is suspended in the slurry 10 within the slurry source tank 12. Furthermore, the acoustic energy sources 22, 24, and 26 include a second acoustic energy source 24 for applying acoustic energy to the slurry 10 from the bottom of the slurry source tank 12, and a third acoustic energy source 26 for applying the acoustic energy to the slurry from the sidewalls of the slurry source tank 12.

Since the first acoustic energy source 22 is located in such a manner that at least a portion thereof is suspended within the slurry 10, acoustic energy can be sufficiently transmitted into the top surface of, and within the mass of, the slurry 10 within the slurry source tank 12. The second and third acoustic energy sources 24 and 26, respectively, are disposed on the bottom and the sidewalls of the slurry source tank 12, so that acoustic energy can be sufficiently transmitted in all areas within the slurry source tank 12. Thus, any abrasive particle clumps created by agglomeration of primary particles within the slurry 10 can be completely de-agglomerated into the form of primary particles by acoustic energy generated by the respective acoustic energy sources 22, 24, and 26.

Furthermore, a slurry circulating line 42 for circulating the slurry 10 is connected to the slurry source tank 12. The outlet and inlet of the slurry source tank 12 are connected to a slurry discharge line 42*a* and a slurry collecting line 42*b*, respectively, in combination forming the slurry circulating line 42. The slurry discharge line 42*a* includes a circulating pump 32. The slurry 10 drawn out of slurry source tank 12 is circulated along the circulating line 42 and returned to the slurry source tank 12, thereby preventing abrasive particles from becoming re-agglomerated in the slurry due to stagnation.

The slurry collecting line 42*b* of the slurry circulating line 42 includes a filter 30 for filtering the slurry drawn from the slurry source tank 12. The filter 30 is provided for filtering abrasive particles having an oversize diameter such to prevent any such particles from being re-introduced into the slurry 10, so as to increase the performance of the application of ultrasonic energy in preventing the occurence of small-sized abrasive particles in the slurry 10. The filter 30 is preferably replaced once in every regular cycle. During filter replacement, or when the filter is otherwise not in operation, bypass valves 46 and 48 are operated in such a manner as to cause the slurry 10 flow to detour the filter 30 along a bypass line 52, such that the slurry 10 continues to circulate.

The slurry circulating line 42 includes a three-way solenoid valve 44 for selectively directing the flow of slurry 10 supplied from the slurry supplying apparatus 100 into a polishing pad 62 of CMP equipment through a slurry supplying line 43. The slurry flowing out into the slurry supplying line 43 can be directly supplied onto the polishing pad 62 during the CMP process. When necessary, the slurry 10 flowing out of the slurry supplying line 43 can alternatively be stored in a reservoir 64 following pre-treatment of the slurry 10 for a predetermined time period in the slurry supplying apparatus 100. It has been demonstrated that no change in the diameter of abrasive particles occurs as time lapses, even when the slurry 10 pre-treated in the slurry supplying apparatus 100 according to the present invention was stored up to fifteen days. Thus, even when the slurry 10 pre-treated in the slurry supplying apparatus 100 according to the present invention is preserved in the reservoir 64 and then supplied in a CMP process, the likelihood of producing micro-scratches, which may cause defects in a semiconductor device on the polished surface of a wafer, is mitigated and/or eliminated.

Figure 2:
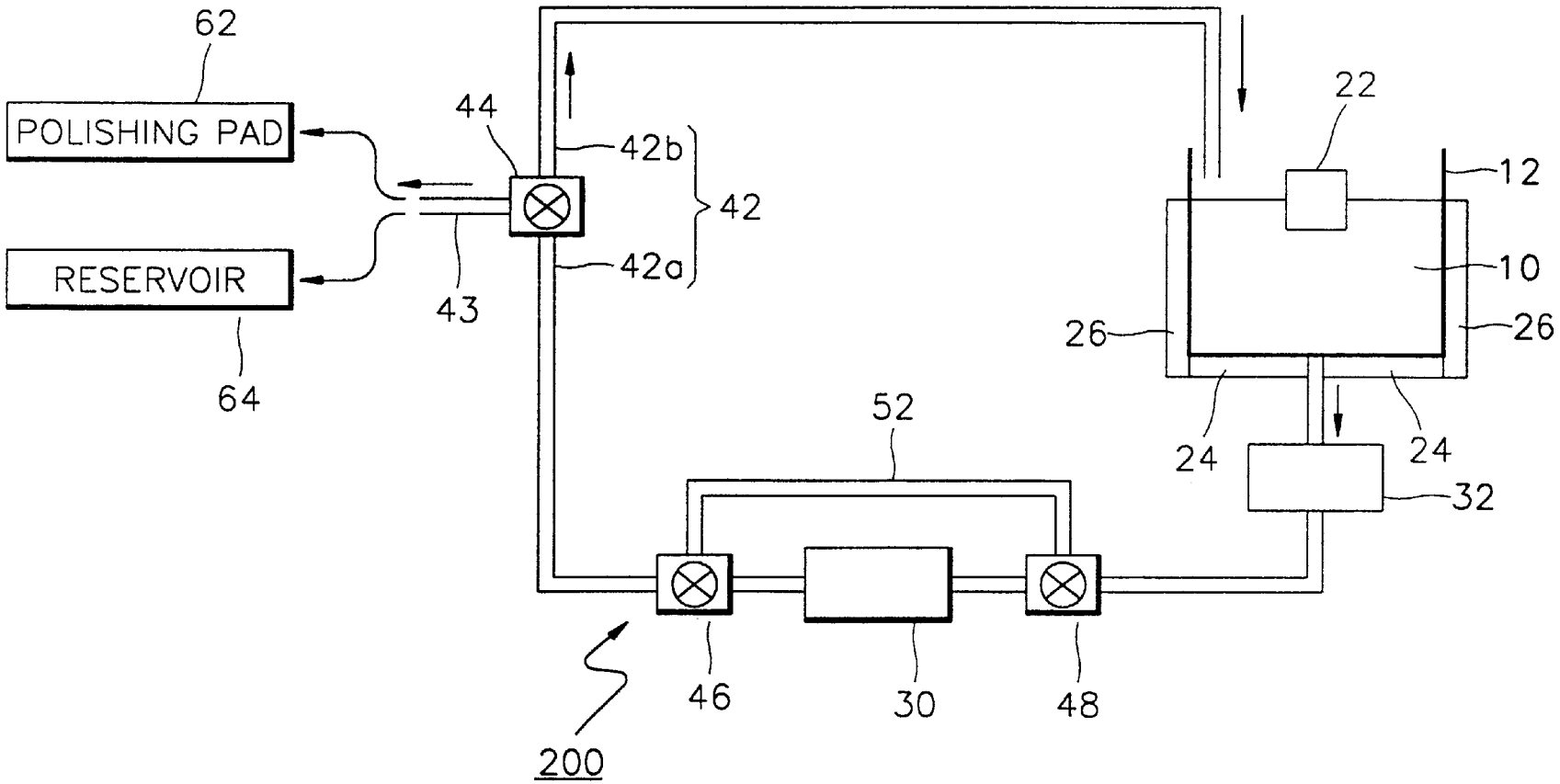
FIG. 2 schematically illustrates the configuration of a primary portion of a slurry supplying apparatus according to a second preferred embodiment of the present invention.

FIG. 2 schematically illustrates the primary portion of the slurry supplying apparatus 200 according to another preferred embodiment of the present invention. The configuration shown in FIG. 2 is similar to that in FIG. 1, except that the filter 30, bypass line 52 and valves 46 and 48 are installed in the slurry discharge line 42*a*. The case in which the filter 30 is disposed in the slurry collecting line 42*b* as shown in the slurry supplying apparatus 100 of FIG. 1 and the case in which the filter 30 is disposed in the slurry discharge line 42*a* as in the slurry supplying apparatus 200 of FIG. 2 provide the same effect.

Figure 3:
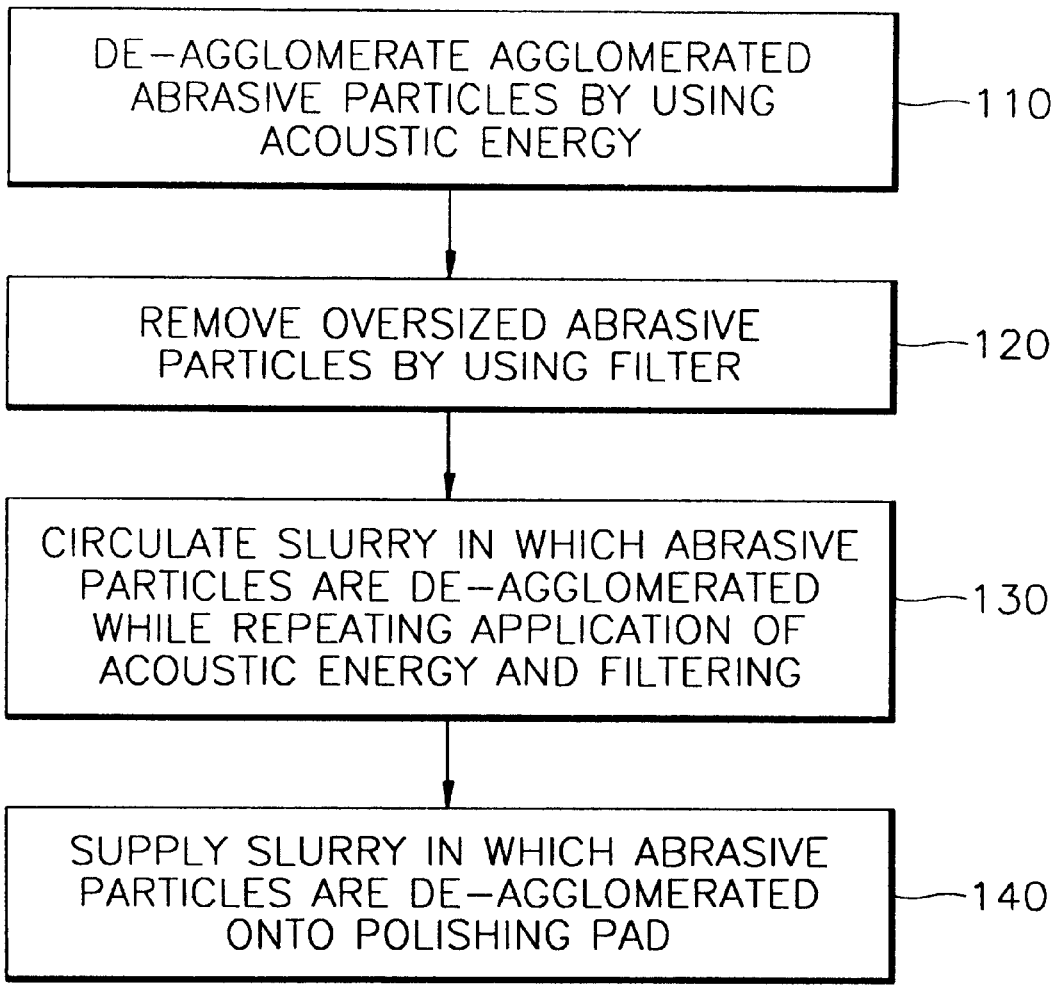
FIG. 3 a flowchart for explaining a slurry supplying method according to a preferred embodiment of the present invention.

FIG. 3 is a flowchart for explaining a slurry supplying method according to a preferred embodiment of the present invention. The slurry supplying method according to the present invention can be implemented by using the slurry supplying apparatus of FIG. 1 or 2, and it will now be described in detail with reference to those drawings.

In the slurry supplying method according to the present invention, initially agglomerated abrasive particles contained in the slurry 10 held within the slurry source tank 12 are de-agglomerated using acoustic energy applied from the acoustic energy source 22, 24, or 26 disposed in the slurry source tank 12 (step 110). Exemplary types of slurry 10 applicable to the slurry supplying method according to the present invention include ceria slurry, silica slurry, and alumina slurry. As described above, it is possible to use ultrasonic transducers as the acoustic energy sources 22, 24, and 26. In this case, the power applied to the ultrasonic transducers can be varied in the range of 50–2,000 W depending on the type of wafer, and established so that ultrasonic energy having a frequency of 10–100 kHz may be generated.

In particular, since the first acoustic energy source 22 is disposed in such a way that at least a portion thereof is soaked in the slurry 10 within the slurry source tank 12, acoustic energy is transmitted evenly within the slurry 10. Furthermore, if the second or third acoustic energy source 24 or 26 is used in addition to the first acoustic energy source 22, acoustic energy is sufficiently transmitted from the bottom or sidewalls of the slurry source tank 12 into the slurry 10, so that agglomerated abrasive particles within the slurry 10 are completely de-agglomerated.

Following de-agglomeration of the abrasive particles contained in the slurry 10, the slurry 10 discharged from the slurry source tank 12 to the slurry circulating line 42 passes through the filter 30, thereby filtering out oversized abrasive particles that remain, even after acoustic energy is applied within the slurry (step 120).

In order to prevent re-agglomeration due to stagnation of the slurry 10, the slurry in which abrasive particles are de-agglomerated by applying acoustic energy is continuously circulated, by repeating the step of applying acoustic energy as described in step 110 and the filtering step as described in step 120 for a predetermined time period (step 130).

If the slurry, treated to a desired state in which the abrasive particles are completely de-agglomerated and the oversized abrasive particles are removed, is obtained by performing the process in the step 130 for a predetermined time, the slurry is then supplied onto the polishing pad 62 of the CMP equipment to proceed with a CMP process (step 140).

Figure 4:
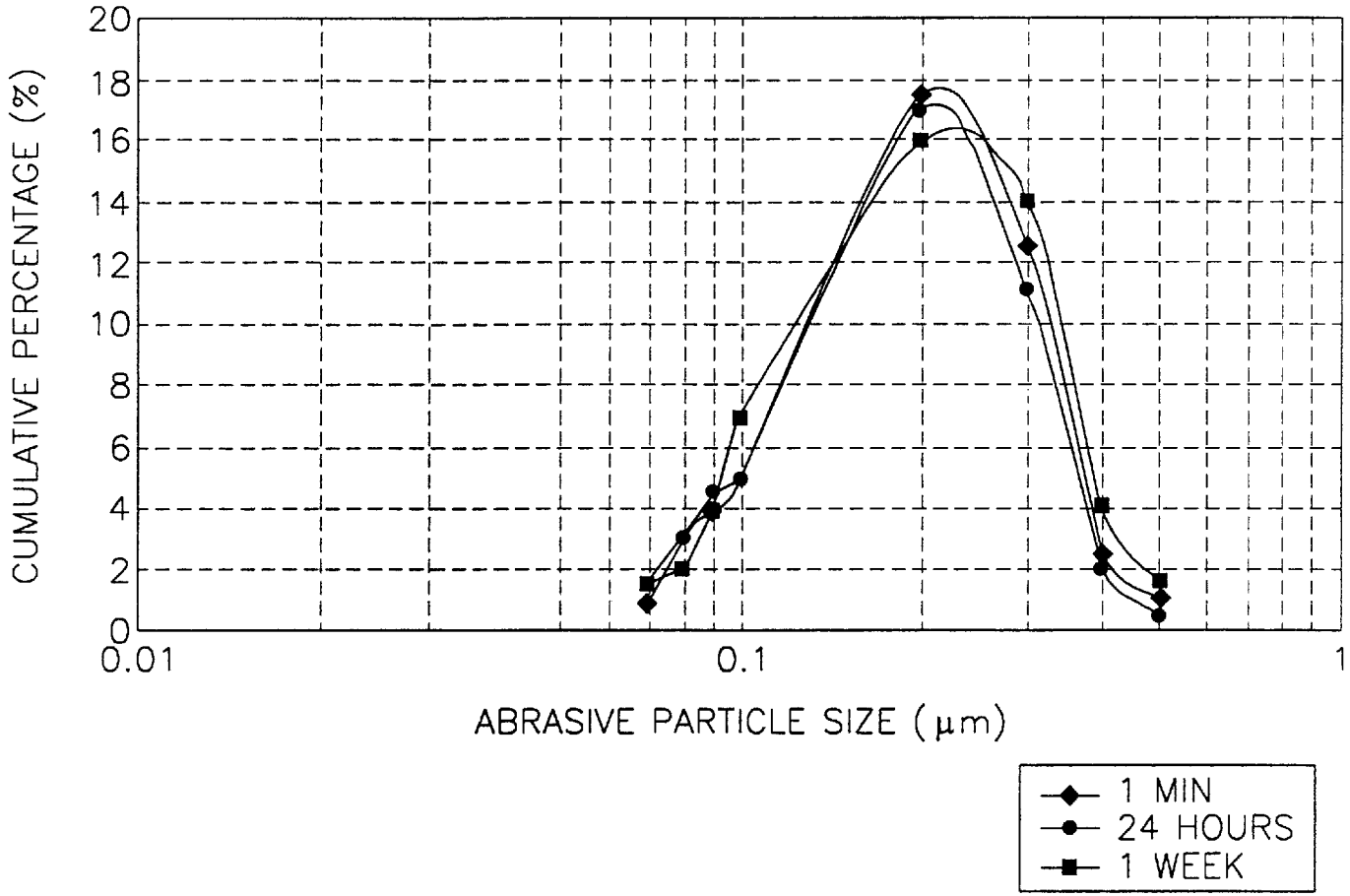
FIG. 4 is a graph indicating abrasive particle size distribution within the slurry processed by the slurry supplying method according to the present invention.

FIG. 4 illustrates the distribution of abrasive particle size within the slurry obtained as a result of treating the slurry according to the slurry supplying method described with reference to FIG. 3. FIG. 4 shows the results of performing the circulating step shown in the step 130 of FIG. 3 for 1 minute, 24 hours, and 1 week, respectively. In order to obtain the results shown in FIG. 4, a ceria slurry measured to have an average diameter of 1.2 $\mu$m for abrasive particles was used as a slurry sample for test, an acoustic transducer was disposed in the slurry source tank 12 as the first acoustic energy source 22, to which a power of 200 W was applied, and a filter which is manufactured by Millipore Co., Ltd., and sold under the brand name "CMP1" was used as the filter 30. It could be found from the results of FIG. 4 that an abrasive particle size within the slurry was distributed below 0.5 $\mu$m as a result of treating the slurry by the slurry supplying method according to the present invention. Thus, the de-agglomeration efficiency of abrasive particles in the slurry supplying method according to the present invention was very high.

Figure 5:
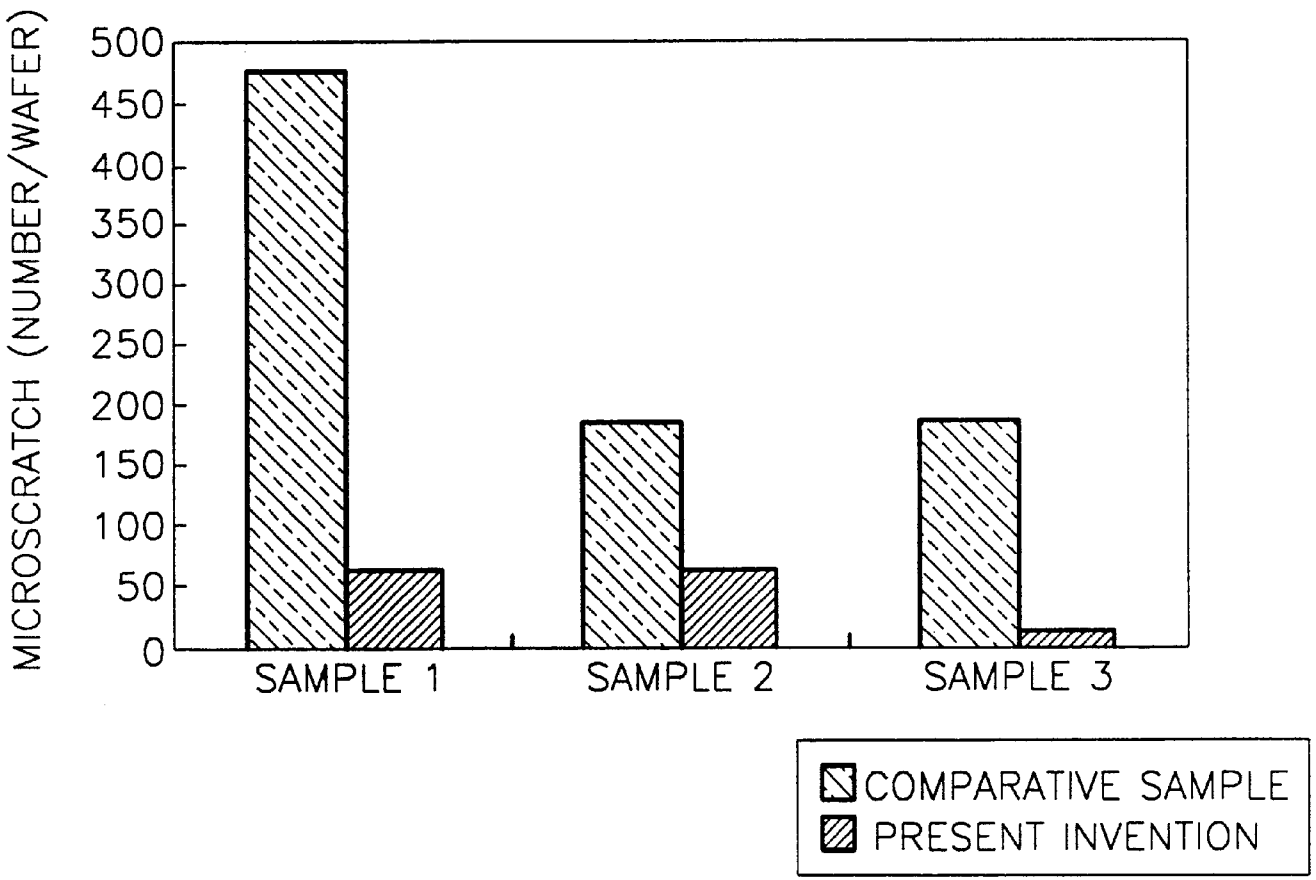
FIG. 5 is a graph of the results of measuring micro-scratches produced on the polished surface of a wafer when the slurry is applied to a chemical mechanical polishing (CMP) process following treatment by the slurry supplying method according to the present invention, with comparative samples.

FIG. 5 is a graph of comparing the results of measuring micro-scratches created on the polished surface of a wafer when treating the slurry according to the slurry supplying method described with reference to FIG. 3 and then applying an actual CMP process using thus treated slurry with comparative samples. For comparison in FIG. 5, a ceria slurry, which is identical to the sample used for measurement in FIG. 4, was classified as "sample 1", "sample 2", and "sample 3", respectively, and the residual silicon oxide film of a shallow trench isolation (STI) pattern on a wafer was polished by CMP after the slurry in each sample was treated according to the slurry supplying method shown in FIG. 3. A silicon nitride film stopper was removed on a wafer on which the CMP process was completed, and thereafter micro-scratches were measured by a common measurement method, using a wafer inspection device "AIT" available from KLA-Tencor Co., Ltd. Treatment conditions other than the above conditions were applied in the same manner as the measurement shown in FIG. 4. Here, each sample in the comparative samples was treated only by a stirring step, instead of applying the method according to the present invention.

When each treatment was applied to the respective samples for three minutes, the control example showed that micro-scratches having a size of above 0.2 $\mu$m are formed about 150–500 per wafer, while a treatment by the present invention showed that micro-scratches having a size of above 0.2 $\mu$m are significantly reduced to about 7–63 per wafer.

The slurry supplying apparatus according to the present invention includes an acoustic energy source positioned such that at least a portion thereof is immersed in a slurry held within a slurry source tank. Thus, acoustic energy is uniformly applied to the slurry in all regions within the slurry source tank. Furthermore, a slurry circulating line is disposed so that the slurry drawn from the slurry source tank is continuously circulated and then lead backs to the slurry source tank. Therefore, since the slurry is maintained in fluid state, re-agglomeration of abrasive particles caused by slurry stagnation can be prevented. In addition, a filter is disposed in the slurry circulating line in order to remove oversized abrasive particle clumps that are not de-agglomerated even by applying acoustic energy. Thus, the likelihood that agglomerated abrasive particles or oversized abrasive particles exist in the slurry supplied through the slurry supplying apparatus according to the present invention is mitigated or eliminated, thereby preventing micro-scratches which may cause the defective semiconductor device from occurring on the polished surface of a wafer during a CMP process.

Furthermore, in the slurry supplying method according to the present invention, agglomerated abrasive particles within the slurry are de-agglomerated by using acoustic energy, oversized abrasive particles are removed by using a filter, and the resulting treated slurry is continuously circulated through a slurry circulating line while repeating a step of applying acoustic energy to the slurry and a step of filtering the slurry. Accordingly, the presence of oversized abrasive particles having so large a diameter that microscratches are produced on the polished surface of a wafer is mitigated or eliminated, and re-agglomeration due to stagnation of the slurry can be prevented.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of supplying a slurry for a chemical mechanical polishing (CMP) process, the method comprising the steps of:

applying acoustic energy to a slurry held within a tank, the tank having sidewalls and a bottom, for a process to de-agglomerate agglomerated abrasive particles within the slurry, the acoustic energy being supplied by a first acoustic energy source a portion of which is immersed in the slurry, a second acoustic energy source at the tank bottom, and a third acoustic energy source at the tank sidewalls;

filtering out oversized abrasive particles having a diameter greater than a reference size from the slurry to which the acoustic energy is applied;

circulating the slurry during application of the acoustic energy and during filtering for a predetermined time period; and supplying the slurry subjected to the circulating step to a CMP equipment.

2. The method of claim 1, wherein an ultrasonic transducer is employed as the acoustic energy source.

3. The method of claim 2, wherein ultrasonic energy is applied to the slurry at a power of 50–2,000 W applied to the ultrasonic transducer.

4. The method of claim 2, wherein the ultrasonic transducer applies ultrasonic energy having a frequency of 10–100 KHz to the slurry.

5. The method of claim 1, wherein the slurry is selected for a group of slurries consisting of ceria slurry, silica slurry, and alumina slurry.

6. An apparatus for supplying a slurry for a chemical mechanical polishing (CMP) process, the apparatus comprising:

a tank for holding a slurry, the tank having sidewalls and a bottom;

acoustic energy sources for applying acoustic energy to the slurry held within the tank, the acoustic energy sources including a first acoustic energy source at least a portion of which is immersed in the slurry, a second acoustic energy source at the bottom of the tank, and a third acoustic energy source at the sidewalls of the tank;

a slurry circulating line connected to the tank for circulating slurry drawn from the tank;

a filter disposed in the slurry circulating line for filtering out abrasive particle clumps having a diameter greater than a reference size from the slurry; and a slurry supplying line for supplying the slurry from the slurry circulating line to a CMP equipment.

7. The apparatus of claim 6, wherein the acoustic energy source is an ultrasonic transducer.

8. The apparatus of claim 7, wherein the ultrasonic transducer is operated at a power of 50–2,000 W.

9. The apparatus of claim 7, wherein the ultrasonic transducer generates ultrasonic energy having a frequency of 10–100 KHz.

10. The apparatus of claim 6, wherein the slurry circulating line includes a slurry discharge line connected to an outlet of the tank and a slurry collecting line connected to an inlet of the tank.

11. The apparatus of claim 10, wherein the filter is disposed in the slurry discharge line.

12. The apparatus of claim 10, wherein the filter is disposed in the slurry collecting line.

13. The apparatus of claim 10, wherein the slurry circulating line further includes a bypass line for bypassing the filter so that the slurry can be circulated without passing through the filter.

* * * * *

UNITED STATES PATENT AND TRADEMARK OFFICE

CERTIFICATE OF CORRECTION

PATENT NO. : 6,585,570 B2 
DATED : July 1, 2003
INVENTOR(S) : Jung-yup Kim et al.

It is certified that error appears in the above-identified patent and that said Letters Patent is hereby corrected as shown below:

Column 8,
Line 2, delete "for" and insert -- from --.
Line 39, delete "claim 10" and insert -- claim 6 --.

Signed and Sealed this

Twentieth Day of January, 2004

JON W. DUDAS
*Acting Director of the United States Patent and Trademark Office*